US008151766B2

(12) United States Patent
Fukuuchi

(10) Patent No.: US 8,151,766 B2
(45) Date of Patent: Apr. 10, 2012

(54) COMBUSTION ENGINE AND VEHICLE EQUIPPED WITH SUCH ENGINE

(75) Inventor: Masashi Fukuuchi, Kobe (JP)

(73) Assignee: Kawasaki Jukogyo Kabushiki Kaisha, Hyogo (JP)

( * ) Notice: Subject to any disclaimer, the term of this patent is extended or adjusted under 35 U.S.C. 154(b) by 358 days.

(21) Appl. No.: 12/537,164

(22) Filed: Aug. 6, 2009

(65) Prior Publication Data

US 2010/0162997 A1 Jul. 1, 2010

(30) Foreign Application Priority Data

Sep. 8, 2008 (JP) ..... 2008-229557

(51) Int. Cl.
*F02D 9/02* (2006.01)
*F02D 9/10* (2006.01)

(52) U.S. Cl. ..... 123/399; 123/336; 123/337

(58) Field of Classification Search ..... 123/399, 123/336, 337

See application file for complete search history.

(56) References Cited

U.S. PATENT DOCUMENTS

| | | | | |
|---|---|---|---|---|
| 7,533,653 | B2 * | 5/2009 | Hotta | 123/336 |
| 7,726,280 | B2 * | 6/2010 | Nishimura et al. | 123/399 |
| 2005/0133004 | A1 * | 6/2005 | Maehara et al. | 123/336 |
| 2005/0155571 | A1 * | 7/2005 | Hanasato | 123/336 |
| 2006/0169223 | A1 | 8/2006 | Tabata et al. | |
| 2008/0078355 | A1 * | 4/2008 | Maehara et al. | 123/399 |
| 2008/0078357 | A1 * | 4/2008 | Hotta et al. | 123/403 |
| 2008/0184958 | A1 * | 8/2008 | Sato et al. | 123/336 |
| 2009/0084352 | A1 * | 4/2009 | Nishimura et al. | 123/399 |
| 2009/0095254 | A1 * | 4/2009 | Yamada | 123/337 |

FOREIGN PATENT DOCUMENTS

JP 2006-214293 8/2006

* cited by examiner

*Primary Examiner* — Erick Solis

(57) ABSTRACT

A combustion engine includes an cylinder block having a combustion chamber formed therein, a throttle body forming a part of an air intake passage for introducing an air therethrough into the combustion chamber, a throttle valve accommodated in the throttle body for adjusting a cross section of the air intake passage, and an electrically driven throttle device having an actuator for driving the throttle valve. At least a portion of the throttle body is positioned intermediate between the actuator and the cylinder block.

20 Claims, 5 Drawing Sheets

COMBUSTION ENGINE AND VEHICLE EQUIPPED WITH SUCH ENGINE

CROSS REFERENCE TO THE RELATED APPLICATION

This application is based on and claims priority to the Japanese patent application No. 2008-229557, filed Sep. 8, 2008, which is herein incorporated by reference in its entirety into this application.

BACKGROUND OF THE INVENTION

1. Field of the Invention

The present invention relates to a combustion engine equipped with an electrically operated throttle device.

2. Description of the Prior Art

An electrically operated throttle device used in motor vehicles such as, for example, motorcycles for controlling the air flow within an air intake passage has hitherto been suggested, which includes a throttle body defining in the air intake passage therein, a throttle valve accommodated within the throttle body for adjusting the cross section of the air intake passage, and an actuator for driving the throttle valve between a substantially closed position and a full open position and positioned in a lower portion of the throttle body. This known electrically operated throttle device is disclosed in, for example, the Japanese Laid-open Patent Publication No. 2006-214293.

According to the above mentioned Japanese publication, the known electrically operated throttle device is provided with a cooling unit for introducing a part of the intake air flowing through the air intake passage towards the actuator to cool the latter. It has, however, been found that the use of the cooling unit requires a portion of the air intake passage to be modified, or otherwise, renovated, to accommodate the cooling unit in the air intake passage and, therefore, the electrically operated throttle device as a whole tends to become complicated in structure.

SUMMARY OF THE INVENTION

In view of the foregoing, the present invention has been devised to substantially eliminate the above described disadvantages and inconveniences inherent in the prior art electrically operated throttle device and is intended to provide a combustion engine equipped with an air intake system employing electrically operated throttle device of a simplified structure, in which the use of the cooling unit for cooling the actuator is dispensed with.

Another related object of the present invention is to provide a motor vehicle equipped with the combustion engine.

In order to accomplish the foregoing objects of the present invention, there is provided a combustion engine, which includes a cylinder block having a combustion chamber defined therein; and an electrically driven throttle device having a throttle body forming a part of an air intake passage for introducing an air into the combustion chamber and accommodating therein a throttle valve for adjusting a cross section of the air intake passage for regulating the flow of air to be introduced into the combustion chamber, and an actuator for driving the throttle valve. The electrically driven throttle device is arranged spaced a distance from the cylinder block, and at least a portion of the throttle body is positioned intermediate between the actuator and the cylinder block.

According to the present invention, that portion of the throttle body intervening between the cylinder block and the actuator of the electrically driven throttle device serves as a heat insulating element to prevent heat, generated in the cylinder block, from being transmitted by radiation to the actuator directly. Accordingly, even without the cooling unit used to cool the actuator, the actuator can assume a stable and consistent operation and, therefore, the combustion engine of the present invention can be advantageously simplified in structure with no cooling unit used.

In a preferred embodiment of the present invention, the combustion engine has a plurality of cylinder blocks arranged in cylinder banks set at an angle relative to each other so as to define a generally V-shaped inter-bank space between those cylinder blocks and the electrically driven throttle device is positioned within such V-shaped inter-bank space, and the actuator is positioned above the throttle body.

This structure, in which the electrically driven throttle device is positioned within the V-shaped inter-bank space, makes it possible to achieve an efficient utilization of the V-shaped inter-bank space between the cylinder banks.

Also, by way of example, where the electrically driven throttle device is positioned within the V-shaped inter-bank space, positioning of the actuator at a location below the throttle body will result in positioning of the actuator in proximity to a narrow bottom of the V-shaped inter-bank space. In such case, the actuator comes to a position spaced a small distance from an area of the combustion engine, where a substantial amount of heat is generated, and, therefore, the actuator thereof below the throttle body is undesirable.

Considering that the V-shaped inter-bank space is larger at an upper region thereof than at a lower region adjacent the bottom of the V-shaped inter-bank space, in this preferred embodiment positioning of the actuator above the throttle body is particularly advantageous, as compared with positioning thereof at the bottom of the V-shaped inter-bank space, in that the actuator can be separated a sufficient distance away from that area. Therefore, the actuator is hardly affected by the substantial amount of heat generated by the combustion engine, so as to allow an increase of the temperature of the actuator by the effect of the heat from the combustion engine to be suppressed.

In another preferred embodiment of the present invention, first and second cylinder blocks defines the V-shaped inter-bank space and the first cylinder block is offset to one side relative to the second cylinder block in a direction axially of the combustion engine, and the actuator referred to above is preferably arranged within the V-shaped inter-bank space on the other side opposite to the one side and in proximity to the first cylinder block. This is particularly advantageous in that since the actuator is arranged within the V-shaped inter-bank space on the other side and in proximity to the first cylinder block, that is, arranged at a location ample in space and hence easy to avoid interference with the first cylinder block, the freedom of choice in selecting the site for installation of the actuator can be increased and the an efficient utilization of the space left by the offset between the first and second cylinder blocks can result in increase of the maintenance factor.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DETAILED DESCRIPTION OF THE EMBODIMENTS

A preferred embodiment of the present invention will now be described with particular reference to the accompanying drawings in connection with the present invention as applied to an internal combustion engine for a motorcycle. It is to be noted that the term "left or right of a vehicle body" used in connection with a direction is intended, unless otherwise specified to the contrary, to mean left or right viewed from a motorcycle rider occupying a seat in the motorcycle, respectively.

Figure 1:
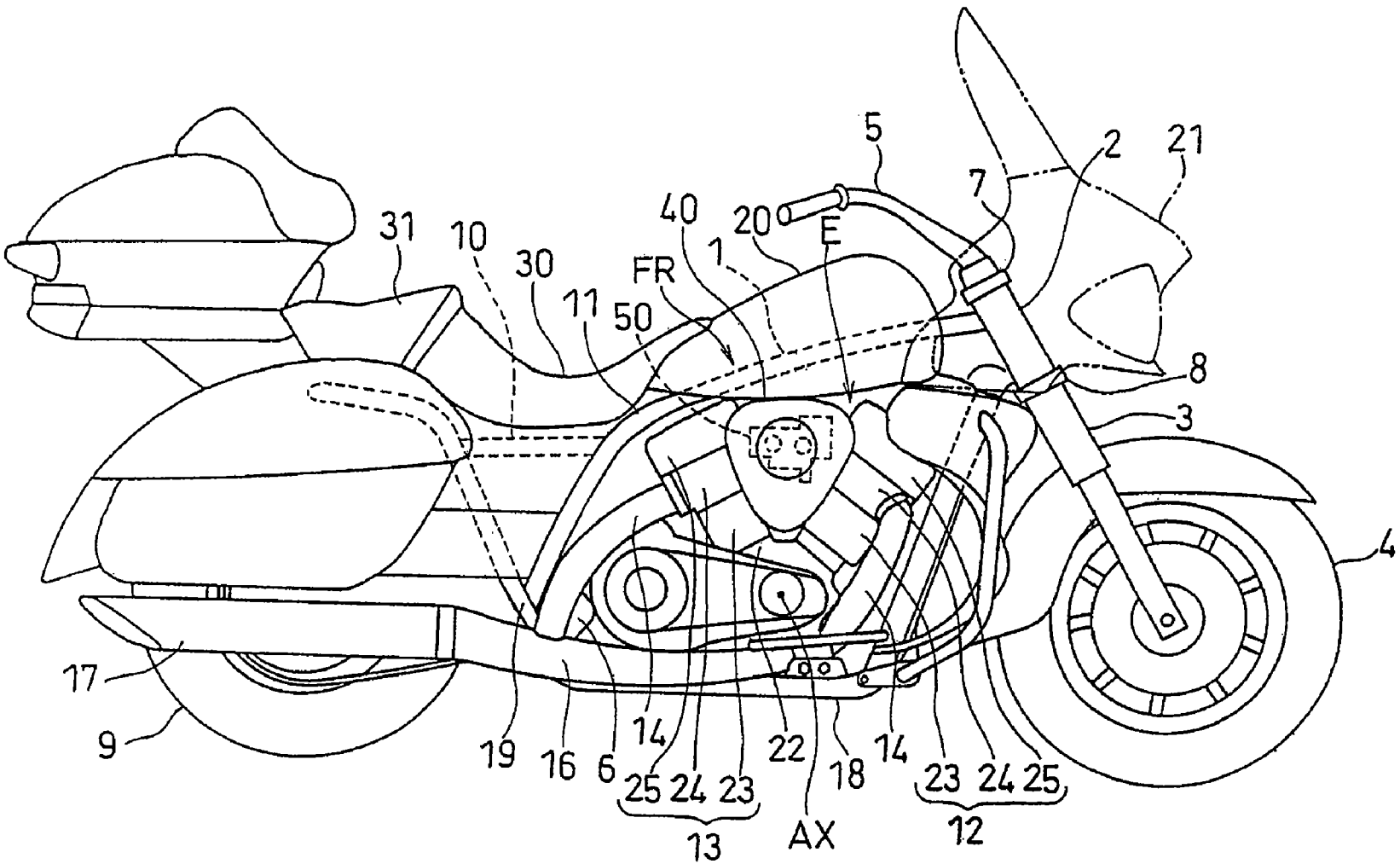
FIG. 1 is a schematic side view of a motorcycle equipped with a combustion engine utilizing an electrically driven throttle device according to a preferred embodiment of the present invention.

Referring to FIG. 1, there is schematically shown a touring type motorcycle as viewed laterally from one side thereof. The motorcycle shown therein includes a motorcycle frame structure FR, which includes a main frame 1 and left and right down tubes 18, both forming a front frame region of the motorcycle frame structure FR. A head tube 2 is secured to respective front ends of the main frame 1 and the left and right down tubes 18. Upper and lower brackets 7 and 8 spaced apart from each other are supported by the head tube 2 for movement together through a steering shaft (not shown) rotatably inserted in the head tube 2. A front fork assembly 3 is supported by the upper and lower brackets 7 and 8 for rotation together with the steering shaft for steering purpose. The front fork assembly 3 has a front wheel 4 rotatably supported at a lower end thereof for rotation in any manner well known to those skilled in the art. A handlebar 5 is rigidly mounted on the upper bracket 7 at an upper end of the front fork assembly 3.

A motorcycle combustion engine E forming a power plant for the motorcycle is mounted in part on the main frame 1 and in part on the down tubes 18 and is used to drive a rear wheel 9 through an endless or generally endless belt or chain (not shown). This motorcycle combustion engine E has an axis of rotation AX oriented in a direction widthwise of the motorcycle.

In the illustrated embodiment, the motorcycle combustion engine E is employed in the form of a four-stroke twin-cylinder engine having two cylinder blocks 12 and 13 juxtaposed in a forward-rearward direction, or a longitudinal direction of the motorcycle, and protrude upwardly from the top of a crankcase 22 while tilted slantwise upwardly in respective senses opposite to each other when viewed sidewise in a direction perpendicular to the longitudinal sense of the motorcycle. Specifically, the cylinder blocks 12 is slantwise upwardly and forwardly tilted and is, therefore, a forward tilted cylinder block whereas the cylinder block 13 is slantwise upwardly and rearwardly tilted and is, therefore, a rearward tilted cylinder block. Those forward and rearward tilted cylinder blocks 12 and 13 are arranged in two cylinder banks installed on the crankcase 22 and set at an angle relative to each other so as to assume a generally V-shaped configuration with a generally V-shaped inter-bank space S defined therebetween. An air cleaner 40 and an electrically driven throttle device 50 are arranged within this V-shaped inter-bank space S.

This motorcycle engine E of the type referred to above includes, for each of the cylinder blocks 12 and 13, an engine cylinder 23 secured on the crankcase 22 and a cylinder head 24 mounted on the engine cylinder 23, as well as a head covering 25 mounted atop the cylinder head 24 to cover an upper region of the respective cylinder head 24. The engine cylinders 23 cooperate with the cylinder heads 24 to define the respective cylinder blocks 12 and 13 therein, and those cylinder blocks 12 and 13 have respective combustion chambers (not shown) defined therein in cooperation with associated reciprocating pistons (not shown) that move within the corresponding cylinder blocks 12 and 13.

Exhaust tubes 14 communicated respectively with a front face of the forward tilted cylinder block 12 and a rear face of the rearward tilted cylinder block 13 and extending laterally outwardly from the respective cylinder heads 24 are communicated with a collecting tube 16 on a right side of the motorcycle, which is in turn communicated with left and right branched exhaust tubes that are communicated to the atmosphere. A silencer 17 is installed inside each of the left and right branched exhaust tubes. It is to be noted that the branched exhaust tubes each having the silencer 17 installed therein may not be positioned each of left and right sides of the motorcycle as shown and described and may be positioned on one side, for example, a right side of the motorcycle in a stacked fashion.

The main frame 1 referred to previously extends rearwardly from the head tube 2 towards a swingarm bracket 6 after having been downwardly curved at a portion defined as 11, and left and right spaced seat rails 10 are rigidly connected with that curved portion 11 of the main frame 1 so as to extending rearwardly therefrom. Respective front halves of the left and right down tubes 18 extend downwardly from the head tube 2 and then bend to extend substantially horizontally and rearwardly towards the swingarm bracket 6. Respective rear halves of the left and right down tubes 18 extend further upwardly rearwardly from the swingarm bracket 6 so as to form left and right reinforcement members 19 that are connected respectively with the seat rails 10. The left and right seat rails 10 connected rigidly with a rear portion of the main frame 1 as described above have a rider's seat 30 and a fellow passenger's seat 31 fixedly mounted thereon.

A fuel tank 20 accommodating a quantity of fuel is fixedly mounted on an upper portion of the main frame 1 and between the handlebar 5 and the rider's seat 30. A fairing 21 made of a synthetic resin is mounted on a front portion of the motorcycle so as to cover a region running from an area forwardly of the handlebar 5 to an area laterally upwardly of the front frame region of the motorcycle frame structure FR.

Figure 2:
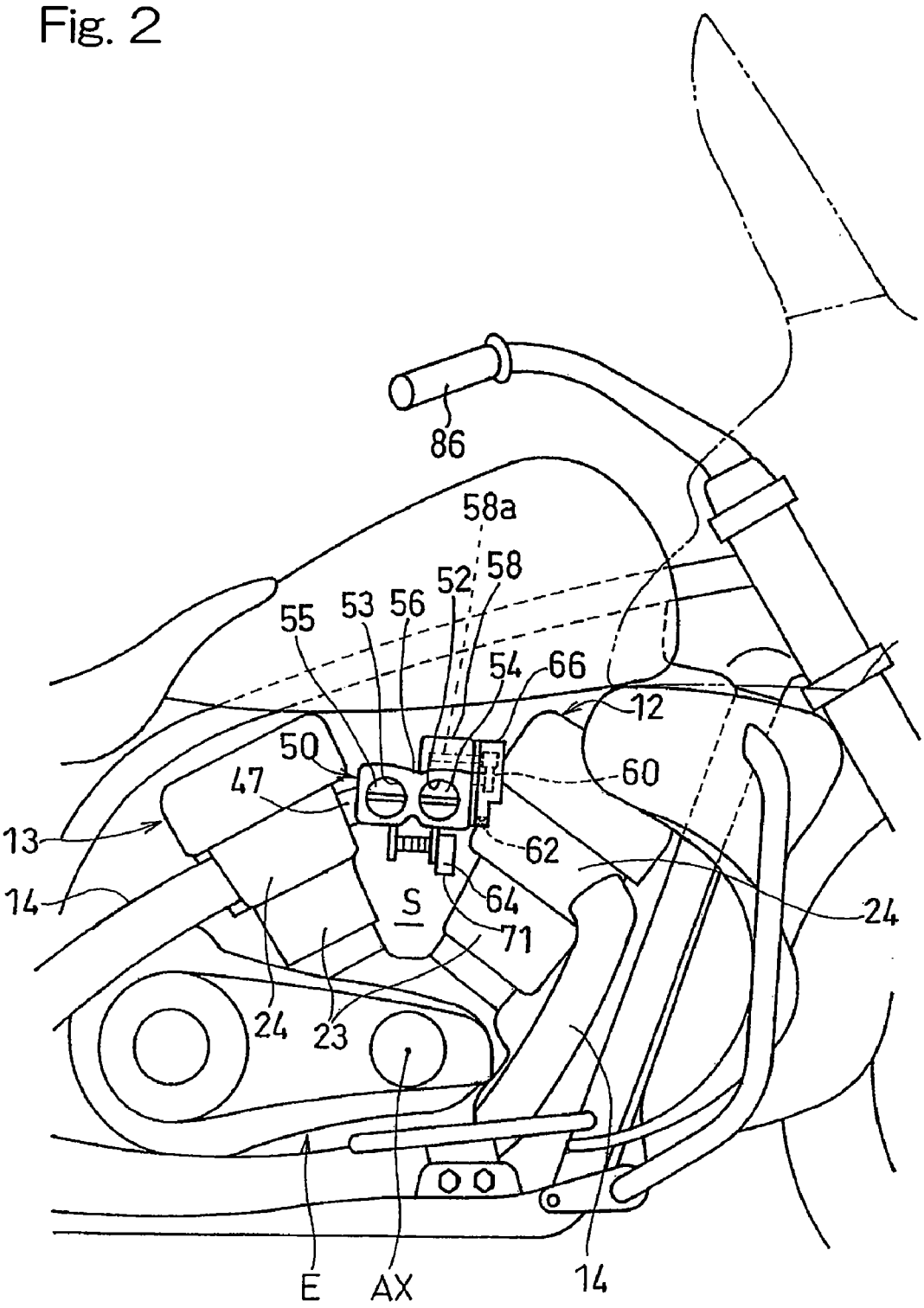
FIG. 2 is a fragmentary side view of the motorcycle, showing the electrically driven throttle device used in the combustion engine.

The electrically driven throttle device 50 is utilized for regulating the flow of air, more specifically the amount of air flowing from the air cleaner 40 towards the combustion engine E and, hence, into the combustion chambers defined inside the engine cylinder 23. As shown in FIG. 2 showing the combustion engine E in a schematic side view with the air cleaner 40 removed therefrom, the electrically driven throttle device 50 includes a throttle body 56 having a pair of air intake passageways 52 and 53 defined therein and also having throttle valves 54 and 55 built in the respective air intake passageways 52 and 53 for adjusting the cross section of those air intake passageways, an actuator 58 disposed upwardly of the throttle body 56 when the electrically driven throttle device 50 is mounted on the motorcycle. The actuator 58 is capable of exerting a driving force necessary to pivot each of the throttle valves 54 and 55 between a full open position and a substantially closed position. The electrically driven throttle device 50 further includes a drive transmitting mechanism 60 for transmitting the driving force of the actuator 58 to each of the throttle valves 54 and 55, and a valve position sensor 62 for detecting the position of each of the throttle valves 54 and 55 between the full open position and the substantially closed position.

The actuator 58 of the electrically driven throttle device 50 is supported by a top surface of the throttle body 56. Accordingly, the throttle body 56 is positioned substantially intermediate between the actuator 58 and the engine cylinder 23 of a high temperature to prevent heat radiating from the engine cylinder 23 from being transmitted to the actuator 58. Since respective portions of the cylinder heads 24 adjacent the electrically driven throttle device 50 serve as the air intake side, the temperature of those portions of the cylinder heads 24 will be lower than that at the engine cylinder 23. Accordingly, the heat radiating from the cylinder heads 24 is partially shielded by the throttle body 56 and will not therefore reach the actuator 58. After all, in order to suppress an increase of the temperature of the actuator 58 brought about by the radiant heat, it suffices that the whole or at least a part of the throttle body 56 be positioned in between the actuator 58 and the engine cylinder 23.

In the practice of the present invention, the actuator 58 is employed in the form of a direct current electric motor, but instead of the DC motor, any of electric motors other than the DC motor, an electromagnetic solenoid or a laminated type piezoelectric element, or a fluid operated motor such as a hydraulic motor can be employed. The electric motors other than the DC motor include, for example, an alternating current motor, a stepping motor or a ultrasonic motor.

The actuator 58 has an output shaft 58*a* extends in the forward-rearward direction and is drivingly coupled with a drive transmitting mechanism 60. The drive transmitting mechanism 60 and the valve position sensor 62 are covered by a gear covering member 66 made of a resinous material and removably fitted to the throttle body 56. Thus, the electrically driven throttle device 50 is integrated together with the throttle body 56, the actuator 58, the drive transmitting mechanism 60 and the valve position sensor 62 into a unitary structure.

Figure 3:
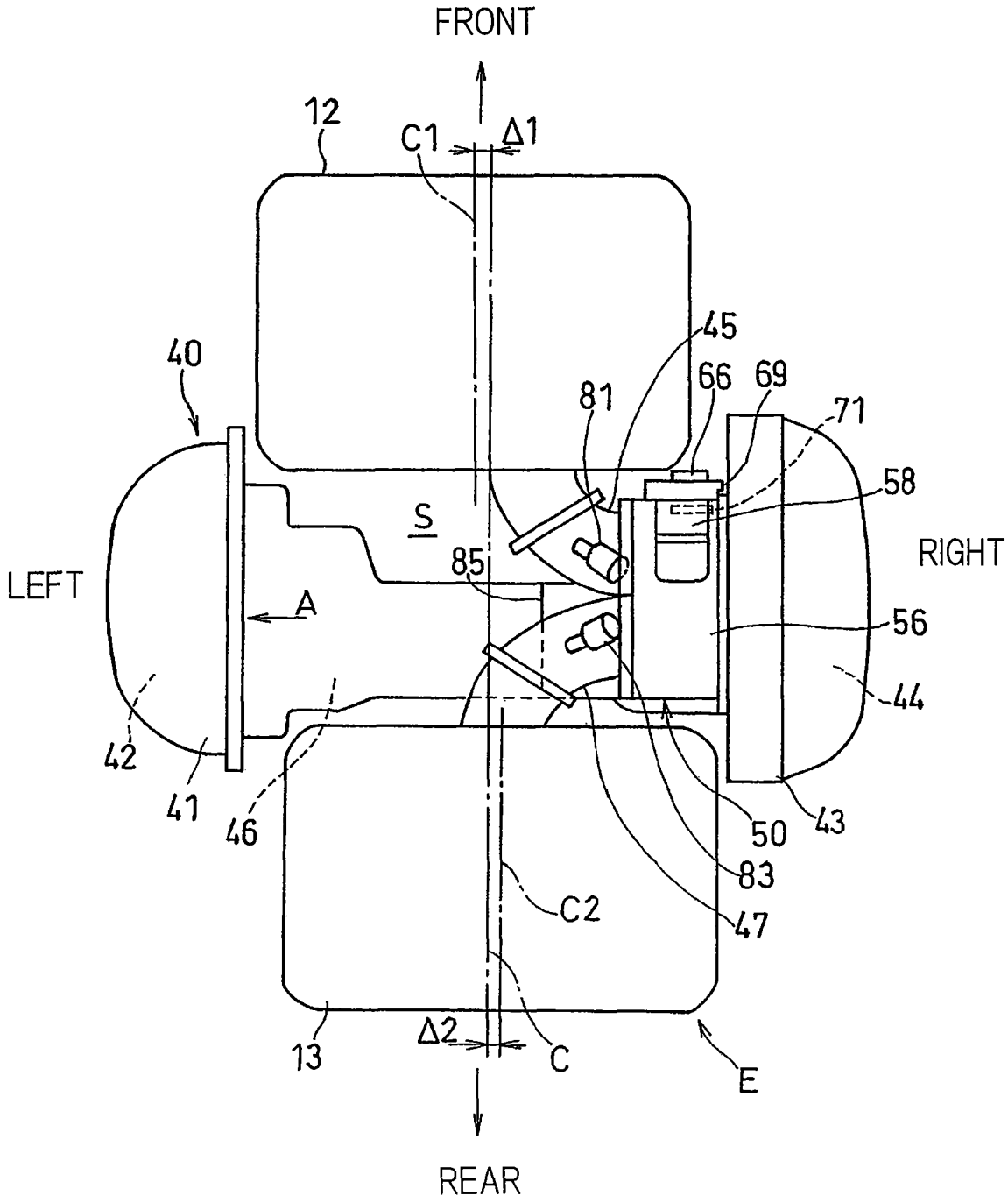
FIG. 3 is a top plan view, on an enlarged scale, showing the electrically driven throttle device.

Referring now to FIG. 3 showing a main portion of the V-twin combustion engine E in a schematic top plan view, the forward tilted cylinder block 12 and the rearward tilted cylinder block 13 are offset relative to each other in a direction widthwise of the motorcycle, that is, in a direction parallel to the axis of rotation AX of the combustion engine E. More specifically, assuming that the cylinder blocks 12 and 13 have longitudinal axes C1 and C2, respectively, the forward tilted cylinder block 12 is offset a first distance Δ1 in a leftward direction from a center line C of a widthwise direction (leftward-rightward direction) of the motorcycle whereas the rearward tilted cylinder block 13 is offset a second distance Δ2 in a rightward direction from the center line C of the widthwise direction of the motorcycle. In the illustrated embodiment, the first distance Δ1 and the second distance Δ2 are chosen to be the same, but may differ from each other. The air cleaner 40 referred to previously is disposed within the V-shaped inter-bank space S so as to confine left and right sides of the motorcycle.

Within the air cleaner 40, a first chamber 42 is arranged on a left side of the combustion engine E, a second chamber 44 is arranged on a right side of the combustion engine E, and a connecting passage 46 communicating between the first and second chambers 42 and 44 extends leftwards and rightwards within the V-shaped inter-bank space S delimited between the forward and rearward tilted cylinders 12 and 13. The electrically driven throttle device 50 is arranged on a right side of the V-shaped inter-bank space S and above the connecting passage 46 of the air cleaner 40. Thus, since the connecting passage 46 is arranged between a heat evolving area of the combustion engine E and the actuator 58, the connecting passage 46 acts as a heat insulating element that is effective to prevent the heat, generated from the engine cylinder 23, from directly transmitting to the actuator 58 by the effect of radiation. The air cleaner 40 includes first and second casings 41 and 43. The first chamber 42 and an upstream portion (a left side portion) of the connecting passage 46 are formed within the first casing 41 and, on the other hand, the second chamber 44 and a downstream portion (a right side portion) of the connecting passage 46 are formed within the second casing 43. The first casing 41 and the second casing 43 are connected in a butted fashion at a butted area 85 located somewhat rightward side of the center line C of the motorcycle. The electrically driven throttle device 50 has its upstream portion communicated with the second casing 43.

The actuator 58 is arranged above and forwardly of the throttle body 56 and in proximity to the forward tilted cylinder block 12 that is offset leftwards, and the actuator 58 has a portion thereof exposed rightwards from the forward tilted cylinder block 12. In other words, the actuator 58 is exposed through a space between the forward tilted cylinder block 12 and the second cover 43 of the air cleaner 40 and, during the travel of the motorcycle, the incoming wind during the travel of the automotive vehicle impinges upon the actuator 58 to thereby cool the actuator 58.

Also, to secure such a large space allows the width of selection of a motor to increase and, hence, the freedom of design can be increased. The drive transmitting mechanism 60 (FIG. 2) and the valve position sensor 62 (also FIG. 2) both covered by the gear covering member 66 are provided in a surface proximate to the forward tilted cylinder block 12 that is offset leftwards, i.e., forwardly of the electrically driven throttle device 50 in the illustrated embodiment, more specifically, forwardly of the throttle body 56. Accordingly, the drive transmitting mechanism 60 can be effectively cooled by the incoming wind.

Figure 4:
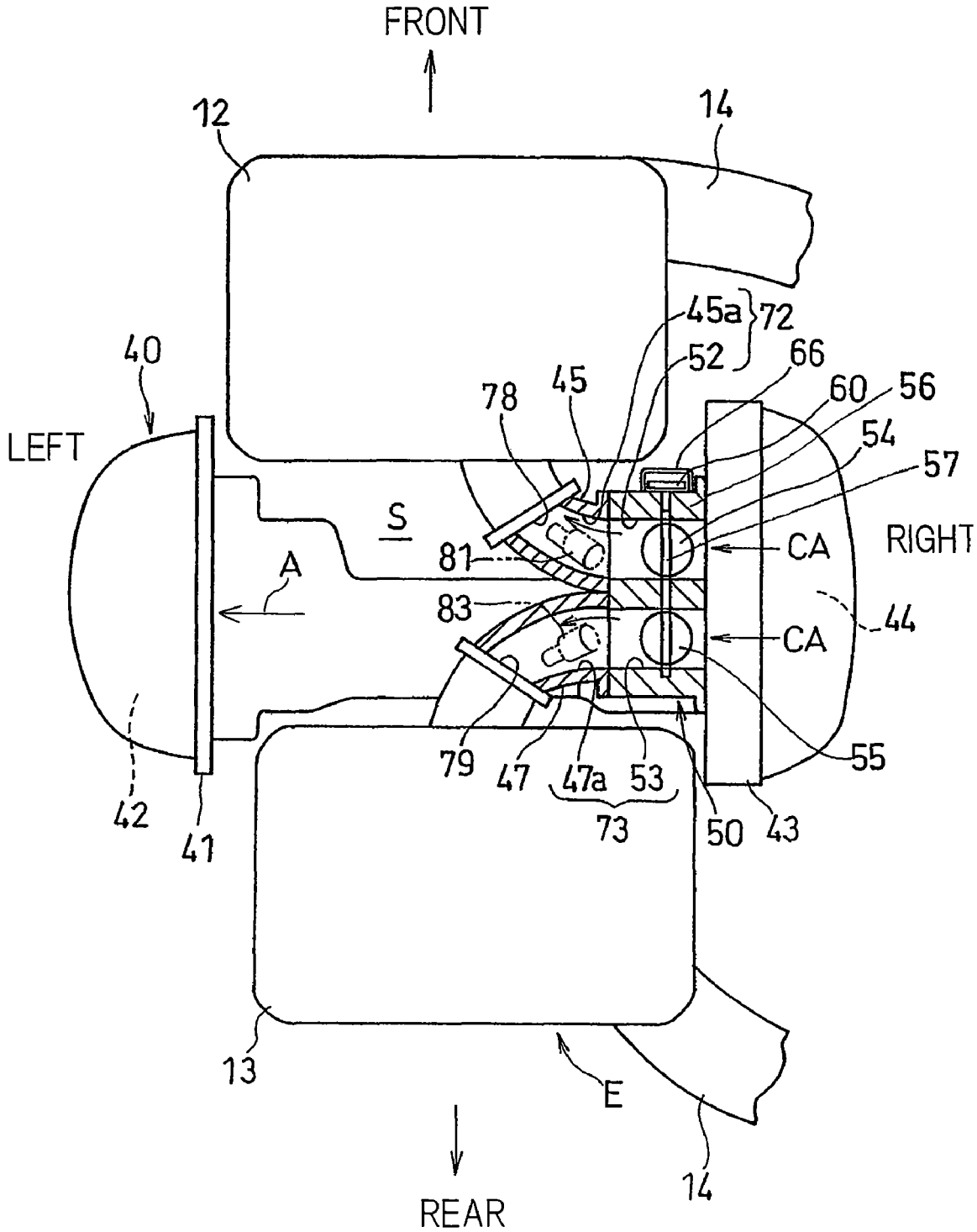
FIG. 4 is a view substantially similar to FIG. 3, showing the electrically driven throttle device with a portion thereof shown in section.

FIG. 4 is a view substantially similar to FIG. 3, but showing a portion of the electrically driven throttle device 50 in section. Referring to FIG. 4, the electrically driven throttle device 50 is connected between intake ducts 45 and 47, communicated respectively with the forward and rearward tilted cylinders 12 and 13, and the second casing 43 of the air cleaner 40. Air intake passageways 52 and 53 of the electrically driven throttle device 50 within the throttle body 56 and air intake passageways 45*a* and 47*a* within the respective intake ducts 45 and 47 that are located downstream thereof altogether form two air intake passages 72 and 73 extending from the air cleaner 40 to the combustion engine E.

Respective upstream sides of the passages 72 and 73 are communicated with the second chamber 44 within the air cleaner 40; a downstream side of the air intake passage 72 on the front side is communicated with an intake port 78 leading to the forward tilted cylinder block 12; and a downstream side of the air intake passage 73 on the rear side is communicated with an intake port 79 leading to the rearward tilted cylinder block 13. An external air A is sucked from an upstream side of the first casing 41 into the first chamber 42 and is, after having become a clean air CA as a result of filtration taking place within the first chamber 42, introduced into the air intake passageways 52 and 53 of the electrically driven throttle device 50 through the connecting passage 46 and then through the second chamber 44. Fuel injection valves 81 and 83 are fitted to respective upper portion of the intake ducts 45 and 47, and air-fuel mixtures are formed within the intake passageways 45*a* and 47*a* of the intake ducts 45 and 47 and are introduced respectively into the intake ports 78 and 79.

The intake passageways 52 and 53 within the throttle body 56 are juxtaposed relative to each other in the forward-rearward direction and in parallel to each other to thereby define passages extending in the leftward or rightward direction, that is, in the direction transverse to the longitudinal sense of the motorcycle. The respective throttle valves 54 and 55 disposed inside the intake passageways 52 and 53 are pivotally supported by the throttle body 56 by means of a common valve pivot axle 57, extending in the forward-rearward direction.

As hereinabove described, the intake ducts 45 and 47 are connected inwardly of the V-shaped inter-bank space S and the exhaust tubes 14 are fluid coupled with the exhaust ports (not shown) positioned outwardly of the V-shaped inter-bank space S. In other words, the intake ports 78 and 79, the temperature of which is low, are disposed within the V-shaped inter-bank space S, whereas the exhaust ports coupled with the exhaust tubes 14, the temperature of which is high, are made open outwardly of or on opposite side of the V-shaped inter-bank space S, and, accordingly, the temperature of the electrically driven throttle device 50 disposed within the V-shaped inter-bank space S and, more particularly, that of the actuator 58 and its surroundings can be suppressed from increasing.

Figure 5:
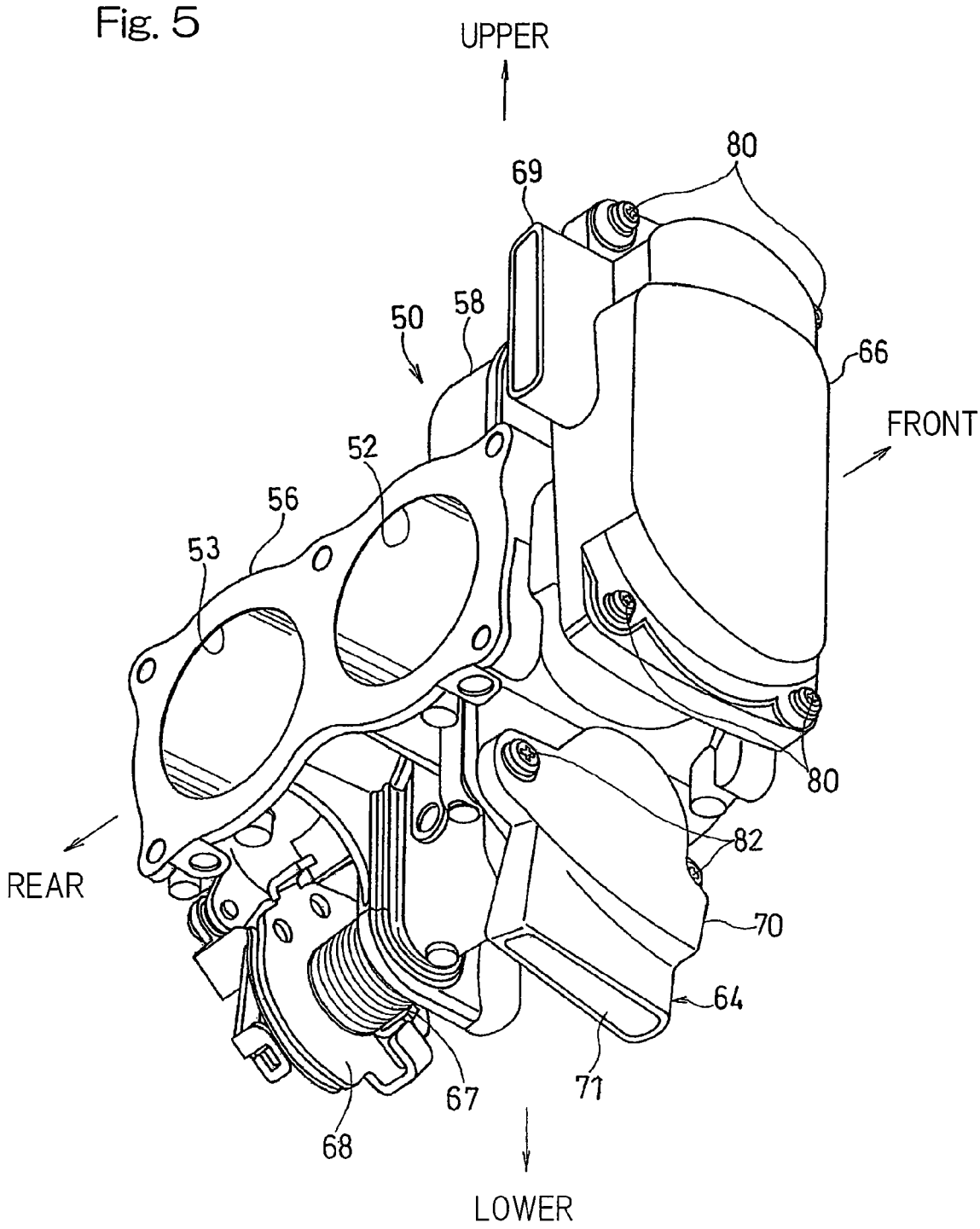
FIG. 5 is a perspective view showing the electrically driven throttle device.

Reference is now made to FIG. 5, which illustrates a perspective view of the electrically driven throttle device 50. As shown therein, the gear covering member 66 of the drive transmitting mechanism 60 are fitted to a front part of the actuator 58 by means of a plurality of, for example, four set screws 80. An operating position sensor 64 for generating a signal indicative of the rotational position of an accelerator grip (a throttle operating member) 86 installed on the handlebar 5 (FIG. 1), that is, a signal indicative of the opening of each of the throttle valves 54 and 55 is disposed below the throttle body 56. The operating position sensor 64 is fitted to a lower portion of the throttle body 56 by means of a plurality of, for example, two set screws 82, so that the operating position sensor 64 and the electrically driven throttle device 50 are unitized together.

When the operating position sensor 64 and the electrically driven throttle device 50 are unitized in the manner described above, the number of assembling steps can be reduced advantageously. The operating position sensor 64 includes a wire 67 connected with the accelerator grip 86, a wire winding unit 68 for taking up the wire 67, and a sensor element (not shown) accommodated within a casing 70 made of a resinous material and operable to detect an angular displacement of the wire winding unit 68. The operating position sensor 64 has a signal connecting portion 71, which is exposed on a right side of the forward tilted cylinder block 12 shown in FIG. 3 and positioned rearwardly of a right side end of the forward tilted cylinder block 12 while opening downwardly as shown in FIG. 2. Accordingly, a signal line can be wired advantageously without interfering with the forward tilted cylinder block 12.

Although in the embodiment hereinabove described the operating position sensor 64 has been shown and described as fitted to the lower portion of the throttle body 56, effects similar to those described above can be equally obtained even if it is fitted to an upper portion of the throttle body 56. Also, the operating position sensor 64 may be provided in the accelerator grip 86 in a manner similar to the conventional operating position sensor, in which an effect to unitize together with the electrically driven throttle device 50 can no longer be available, but instead the electrically driven throttle device 50 can be compactized to such an extent afforded by the absence of the effect to utilize the operating position sensor 64 and the electrically driven throttle device 50 together, and as a result, the air cleaner 40 shown in FIG. 3 can have an increased capacity.

A socket unit 69, with which a cable used to communicate with an engine control unit (not shown) is connected, is provided at an upper right side surface of the electrically driven throttle device 50 shown in FIG. 5. This socket unit 69 is held in proximity to a space on a right side of the forward tilted cylinder block 12 that is offset leftwards as shown in FIG. 3 and, therefore, selective coupling and decoupling of the cable and wiring of the cable can readily be accomplished. Through this cable connected with that socket unit 69, respective signals of the operating position sensor 64 and the valve position sensor 62 shown in FIG. 6 can be transmitted to the engine control unit. Also, through this cable a control signal can be supplied from the engine control unit to the actuator 58. The actuator 58 can be operated based on this control signal to adjust the respective openings of the throttle valves 54 and 55 (FIG. 4) to thereby adjust the respective amounts of the cleaned air CA to be supplied into the combustion engine E through the air intake passages 72 and 73.

In the construction hereinbefore described, at least a portion of the throttle body 56 present between the actuator 58 and the engine cylinder 23 of each of the cylinder blocks 12 and 13 shown in FIG. 2 acts as a heat insulating element to prevent heat, generated in the engine cylinder 23, from being transmitted by radiation to the actuator directly. Accordingly, even without the cooling unit used to cool the actuator 58, the actuator 58 can assume a stable and consistent operation and, therefore, the combustion engine of the present invention can be advantageously simplified in structure with no cooling unit used.

Also, since the actuator 58 is arranged above the throttle body 56, the electrically driven throttle device 50 can be arranged within the V-shaped inter-bank space S in the V-twin combustion engine E to achieve an effective utilization of the V-shaped inter-bank space S. In addition, considering that the V-shaped inter-bank space S is larger at an upper region thereof than at a lower region adjacent the bottom of the V-shaped inter-bank space S, positioning of the actuator 58 above the throttle body 56 is particularly advantageous, as compared with positioning thereof at the bottom of the V-shaped inter-bank space S, in that the actuator 58 can be separated a sufficient distance away from that area, then evolving the substantial amount of heat generated by the combustion engine E, enough to allow an increase of the temperature of the actuator 58 by the effect of the heat from the combustion engine to be suppressed.

The actuator 58 referred to above is arranged adjacent the forward tilted cylinder block 12 and within the V-shaped inter-bank space S on a right side thereof opposite to the left side to which the forward tilted cylinder block 12 is offset, that is, arranged in a site where an ample space is available in the direction parallel to the axis of rotation AX of the combustion engine E. Accordingly, the freedom of choice in selecting the site for installation of the actuator 58 can be increased and an efficient utilization of the space left by the offset between the forward and rearward tilted cylinder blocks 12 and 13 can result in facilitation of the maintenance. Moreover, since the drive transmitting mechanism 60 is also arranged at the site where the ample space is available within the V-shaped inter-bank space S, the drive transmitting mechanism 60 can be arranged at a proper position while interference thereof with surrounding components is avoided.

Furthermore, since the actuator 58, the drive transmitting mechanism 60 and the valve position sensor 62 are arranged by the utilization of the space made available as a result of the offset, a sufficient space for installation can be secured, and also the maintenance can be facilitated. Yet, since a portion of the actuator 58 is exposed laterally rightwards from the motorcycle body, a heat dissipating capability of such exposed portion can be increased to increase the effect of cooling the actuator 58.

Although in the foregoing embodiment of the present invention, the forward tilted cylinder block 12 and the rearward tilted cylinder block 13 have been shown and described as having been offset leftwards and rightwards, respectively, they may be offset in a manner reverse to those described hereinbefore, in which case the actuator 58 can be arranged on a laterally left side of the V-shaped inter-bank space S and in proximity to the forward tilted cylinder block 12. In this way, the actuator 58 can be arranged properly depending on the manner of offset of the forward and rearward tilted cylinder blocks 12 and 13 and the position of the second chamber 44 (on the downstream side) of the air cleaner 40.

In describing the foregoing embodiment of the present invention, reference has been made to a double throttle valve arrangement in which two air intake passageways 52 and 53 are employed and the throttle valves 54 and 55 are disposed inside those air intake passageways 52 and 53, respectively. However, it may be a single throttle valve arrangement, in which only one air intake passageway and only one throttle valve are employed for the two cylinder blocks 12 and 13. Also, separate from the throttle valves operatively linked to an accelerator pedal through the actuator 58, a sub throttle valve that is electronically controlled may be employed.

Also, in describing the foregoing embodiment of the present invention, the latter has been shown and described as applied to the V-twin internal combustion engine. However, since the present invention can serve the purpose when at least a part of the throttle body 56 is arranged intermediate between the engine cylinder 23 and the actuator 58, the present invention can be applied not only to the twin-cylinder engine, but also to a single cylinder combustion engine, a parallel twin combustion engine or a horizontally opposed combustion engine.

Moreover, although in the foregoing embodiment the combustion engine designed in accordance with the present invention has been shown and described as applied to a motorcycle of a touring type, it can be equally applied to any motorcycle other than the touring type, a four wheeled vehicle such as, for example, an off-road vehicle, a saddle type vehicle such as, for example, a small size planing boat, or any other motor vehicle.

Although the present invention has been fully described in connection with the preferred embodiments thereof with reference to the accompanying drawings which are used only for the purpose of illustration, those skilled in the art will readily conceive numerous changes and modifications within the framework of obviousness upon the reading of the specification herein presented of the present invention. Accordingly, such changes and modifications are, unless they depart from the scope of the present invention as delivered from the claims annexed hereto, to be construed as included therein.

What is claimed is:

1. A combustion engine, which comprises:

a cylinder block having a combustion chamber defined therein; and;

an electrically driven throttle device having a throttle body forming a part of an air intake passage for introducing an air into the combustion chamber and accommodating therein a throttle valve for adjusting a cross section of the air intake passage for regulating the flow of air to be introduced into the combustion chamber, and an actuator for driving the throttle valve;

wherein the electrically driven throttle device is arranged spaced a distance from the cylinder block, wherein the actuator is supported by a top surface of the throttle body, and wherein at least a portion of the throttle body is positioned intermediate between the actuator and the cylinder block.

2. The combustion engine as claimed in claim 1, in which the combustion engine has a plurality of cylinder blocks arranged in cylinder banks set at an angle relative to each other so as to define a generally V-shaped inter-bank space between the cylinder blocks, with the electrically driven throttle device arranged within the V-shaped inter-bank space.

3. The combustion engine as claimed in claim 1, in which the combustion engine has first and second cylinder blocks arranged in cylinder banks set at an angle relative to each other so as to define a generally V-shaped inter-bank space between the cylinder blocks, with the electrically driven throttle device arranged within the V-shaped inter-bank space, and in which the first cylinder block is arranged offset to one side relative to the second cylinder block in a direction parallel to an axis of rotation of the combustion engine, and in which the actuator is arranged within the V-shaped inter-bank space on the other side thereof opposite to the one side and in proximity of the first cylinder block.

4. The combustion engine as claimed in claim 3, in which the actuator has at least a portion thereof exposed outwardly from the first cylinder block to the other side of the axis of rotation of the combustion engine.

5. The combustion engine as claimed in claim 3, further comprising a valve position sensor for detecting a position of opening of the throttle valve, the valve position sensor being arranged within the V-shaped inter-bank space on the other side thereof and in proximity to the first cylinder block.

6. The combustion engine as claimed in claim 1, in which the combustion engine has first and second cylinder blocks arranged in cylinder banks set at an angle relative to each other so as to define a generally V-shaped inter-bank space between the cylinder blocks, with the electrically driven throttle device arranged within the V-shaped inter-bank space, and in which the first cylinder block is arranged offset to one side relative to the second cylinder block in a direction parallel to an axis of rotation of the combustion engine, and in which the electrically driven throttle device includes a drive transmitting mechanism for transmitting the actuator to the throttle valve, the drive transmitting mechanism being arranged within the V-shaped inter-bank space on the other side thereof and in proximity to the first cylinder block.

7. The combustion engine as claimed in claim 6, in which the actuator has at least a portion thereof exposed outwardly from the first cylinder block to the other side of the axis of rotation of the combustion engine.

8. The combustion engine as claimed in claim 1, in which the combustion engine has a plurality of cylinder blocks arranged in cylinder banks set at an angle relative to each other so as to define a generally V-shaped inter-bank space between the cylinder blocks, and in which a valve position sensor for detecting a position of opening of the throttle valve is arranged within the V-shaped inter-bank space.

9. The combustion engine as claimed in claim 1, in which the combustion engine has first and second cylinder blocks juxtaposed in a forward-rearward direction perpendicular to an axis of rotation of the engine, to define a V-shaped inter-bank space between those cylinder blocks, with the electrically driven throttle device arranged within the V-shaped inter-bank space; in which the throttle body includes first and second air intake passageways provided in association with the first and second cylinder blocks, respectively, and juxtaposed relative to each other in the forward-rearward direction; in which the throttle valve is provided in each of the first and second air intake passageways with an axis of the throttle valve extending in the forward-rearward direction; and in which the actuator has an output shaft extending parallel to the axis of the throttle.

10. The combustion engine as claimed in claim 1, further comprising a throttle operating member for setting an opening of the throttle valve and an operating position sensor coupled with the throttle operating member for detecting an operating position of the throttle operating member, the operating position sensor being arranged below the throttle body.

11. The combustion engine as claimed in claim 1, further comprising a drive transmitting mechanism for transmitting the actuator to the throttle valve, in which the combustion engine has first and second cylinder blocks juxtaposed in a forward-rearward direction perpendicular to an axis of rotation of the engine, to define a V-shaped inter-bank space between those cylinder blocks, with the electrically driven throttle device arranged within the V-shaped inter-bank space; in which, of the electrically driven throttle device, the actuator is arranged above the throttle body and the drive transmitting mechanism is arranged forwardly of the throttle body.

12. A motor vehicle equipped with the combustion engine as defined in claim 1 as a power plant.

13. The combustion engine as claimed in claim 1, wherein the whole of the throttle body is positioned between the actuator and an engine cylinder of the cylinder block.

14. The combustion engine as claimed in claim 1, wherein the air intake passage includes an upstream air intake passageway of the electrically driven throttle device within the throttle body and a downstream air intake passageway located downstream of the upstream air intake passageway, the upstream air intake passageway extending in a leftward-rightward direction conformed to an axis of rotation of the engine.

15. The combustion engine as claimed in claim 14, further comprising an air cleaner disposed on the left or right side of the engine, wherein the throttle body is disposed between an intake duct forming the downstream air intake passageway and the air cleaner.

16. The combustion engine as claimed in claim 1, further comprising the plurality of cylinder blocks separate from each other, wherein the actuator is disposed between the cylinder blocks.

17. The combustion engine as claimed in claim 16, wherein the air intake passage is communicated with each of the cylinder blocks, and wherein each intake passage has a part provided within the throttle body, and the parts of the respective intake passages are juxtaposed relative to each other in a forward-rearward direction perpendicular to an axis of rotation of the engine and in parallel to each other and extend in a leftward-rightward direction conformed to the axis of rotation of the engine.

18. The combustion engine as claimed in claim 17, wherein the throttle valve has a valve pivot axle extending in the forward-rearward direction.

19. The combustion engine as claimed in claim 14, further comprising air cleaner having first and second chambers disposed on the left and right sides of the engine, respectively, wherein the actuator is arranged above a connecting passage communicating between the first and second chambers.

20. In a motorcycle combustion engine having first and second cylinder blocks arranged in cylinder banks set at an angle relative to each other so as to define a generally V-shaped inter-bank space between the cylinder blocks, with a plurality of combustion chambers in each cylinder block and an air intake passage for introducing air into the plurality of combustion chambers, the improvement comprising:

an electrically driven throttle device having a throttle body forming a part of the air intake passage for introducing air into the combustion chambers and accommodating therein at least one throttle valve for adjusting a cross section of the air intake passage for regulating the flow of air to be introduced into the combustion chambers and an electrical actuator for driving the throttle valve, the electrically driven throttle device is configured to extend within the V-shaped inter-bank space and is spaced a distance from the first and second cylinder blocks, at a location intermediate the V-shaped inter-bank space, wherein the actuator is supported by a top surface of the throttle body in a position that enables the throttle body to block the flow of radiant heat from the first and second cylinder blocks to the actuator, and wherein at least a portion of the throttle body is positioned intermediate between the actuator and the first and second cylinder blocks.

* * * * *